US007084843B2

(12) United States Patent
Yu et al.

(10) Patent No.: US 7,084,843 B2
(45) Date of Patent: Aug. 1, 2006

(54) [LIQUID CRYSTAL DISPLAY PANEL'S INTEGRATED DRIVER DEVICE FRAME]

(75) Inventors: Jian-Shen Yu, Hsinchu (TW); Wein-Town Sun, Kaohsiung (TW)

(73) Assignee: Au Optronics Corporation, Hsinchu (TW)

( * ) Notice: Subject to any disclaimer, the term of this patent is extended or adjusted under 35 U.S.C. 154(b) by 406 days.

(21) Appl. No.: 10/604,629

(22) Filed: Aug. 6, 2003

(65) Prior Publication Data

US 2004/0189562 A1 Sep. 30, 2004

(30) Foreign Application Priority Data

Mar. 28, 2003 (TW) ..... 92107068 A

(51) Int. Cl.
*G09G 3/36* (2006.01)

(52) U.S. Cl. ..... 345/87; 345/100

(58) Field of Classification Search ..... 345/83, 345/84, 87–89, 90–95, 96, 97, 98, 99, 100, 345/204

See application file for complete search history.

(56) References Cited

U.S. PATENT DOCUMENTS

| | | | | |
|---|---|---|---|---|
| 6,046,736 | A * | 4/2000 | Atherton | 345/211 |
| 6,344,841 | B1 * | 2/2002 | Moon | 345/60 |
| 6,771,258 | B1 * | 8/2004 | Aoki | 345/204 |
| 6,909,409 | B1 * | 6/2005 | Tanada | 345/51 |
| 2002/0080104 | A1 * | 6/2002 | Aoki | 345/87 |
| 2002/0167471 | A1 * | 11/2002 | Everitt | 345/76 |
| 2004/0174347 | A1 * | 9/2004 | Sun et al. | 345/204 |

* cited by examiner

*Primary Examiner*—Bipin Shalwala
*Assistant Examiner*—Nitin Patel
(74) *Attorney, Agent, or Firm*—Jiang Chyun IP Office

(57) ABSTRACT

An integrated driver device frame of a liquid crystal display panel is provided. The integrated driver device frame comprises a plurality of driver units, a plurality of driver lines and a plurality of output terminals. Each output terminal is coupled to a corresponding pixel element respectively. In the integrated driver device frame of the invention, the plurality of driver units is arranged with two staggered rows, in order that the driver unit width is larger than the interval of every neighboring two output terminals and is less than two times of the interval. Accordingly, the interval of two neighboring output terminals can be equal to the pixel pitch and the dot-per-inch resolution of the LCD panel can be enhanced.

18 Claims, 3 Drawing Sheets

[LIQUID CRYSTAL DISPLAY PANEL'S INTEGRATED DRIVER DEVICE FRAME]

CROSS REFERENCE TO RELATED APPLICATIONS

This application claims the priority benefit of Taiwan application serial no. 92107068, filed Mar. 28, 2003.

BACKGROUND OF INVENTION

1. Field of the Invention

The present invention relates to an integrated driver device frame. More particularly, the present invention relates to an integrated driver device frame of a liquid crystal display panel.

2. Description of the Related Art

After the liquid crystal material was discovered in Europe, its usage was developed in the USA, and its application within a variety of technology fields is being studied in Japan. Most importantly, the application of a liquid crystal material as Liquid Crystal Display ("LCD") has been used in a many display fields. The generation of a LCD as a Twisted Nematic-Liquid Crystal Display ("TN-LCD") and a Super Twisted Nematic-Liquid Crystal Display ("STN-LCD") has evolved to its use as a Thin Film Transistor-Liquid Crystal Display ("TFT-LCD"). The display area, resolution and image quality have also been enhanced through the continuing development of LCD technology. In recent years, for instance, the development of integrated driver on LCD panel is playing an important role in the improvement of the resolution and the image quality of the LCD panel.

FIG. 4 is a sketch illustrating a conventional integrated driver device frame of a liquid crystal display panel. Referring to FIG. 4, a conventional integrated driver device frame is composed by a plurality of driver units 110, a plurality of output terminals 130, and a plurality of driving lines 120 corresponding to the driver units 110, respectively. Each output terminal 130 is coupled to a corresponding pixel element respectively. As shown in FIG. 4, the driver units 110 of a conventional integrated driver device frame are arranged in a row, and each driver unit 110 is connected to a corresponding driving line 120, respectively. Each output terminal 130 is also coupled to a corresponding driving line 120, respectively. In a conventional integrated driver device frame as shown in FIG. 4, the interval of every two neighboring output terminals 130 is equal to the interval of every two neighboring driver units 110 due to the plurality of the driver units 110 arranged in a row. Therefore, the resolution of the LCD panel is limited to the arrangement and the width of the plurality of the driver units 110 and cannot be enhanced.

FIG. 5 is a sketch illustrating another conventional integrated driver device frame of a liquid crystal display panel. The elements illustrated in FIG. 5 refer to the same elements illustrated in FIG. 4, but with a different arrangement. Referring to FIG. 5, a conventional integrated driver device frame is composed by two rows of driver units 110 located on the opposite side, a plurality of output terminals 130, and a plurality of driving lines 120 corresponding to the driver units 110, respectively. As shown in FIG. 5, each driver unit 110 is connected to a corresponding driving line 120, respectively, and each output terminal 130 is also coupled to a corresponding driving line 120, respectively. Each output terminal 130 is coupled to a corresponding pixel element respectively. In a conventional integrated driver device frame as shown in FIG. 5, the interval of every two neighboring output terminals 130 can be equal to the pixel pitch but the aspect of the total area of the integrated driver device frame will be increased.

SUMMARY OF INVENTION

Accordingly, one object of the present invention is to provide an integrated driver device frame, in which the driver units are arranged with two staggered rows in order to reduce the width of the driver unit and to enhance the resolution of the LCD panel.

To achieve these and other advantages and in accordance with the purpose of the invention, as embodied and broadly described herein, an integrated driver device frame of a liquid crystal display panel is provided. The integrated driver device frame comprises a plurality of driver units, a plurality of output terminals and a plurality of powers. The relationship between the driver unit width and the interval of two neighboring output terminals is that the driver unit width is larger than the interval of two neighboring output terminals and less than two times of the interval of two neighboring output terminals. Each output terminal 130 is coupled to a corresponding pixel element respectively.

In the preferred embodiment of the invention, the plurality of driver units described above have their own driver unit width, respectively. The plurality of driver units are arranged with two staggered rows, in which one of the driver units in a row is contiguous to at least one of the driver units in another row, and each driver unit drives a driving line, respectively.

In the preferred embodiment of the invention, the plurality of driver units described above are coupled to their corresponding driving lines, respectively.

In the preferred embodiment of the invention, the plurality of power sources described above provides a first power line having a first polarity, a second power line and a third power line having a second polarity. Moreover, the plurality of driver units are coupled to the first power line, and a first part of the plurality of driver units are further coupled to the second power line and a second part of the plurality of driver units are further charge coupled to the third power line.

In a preferred embodiment of the invention, the power sources described above may also provide a first power line having a first polarity and a second power line having a second polarity, wherein the first power line has a first main line and a plurality of first branches and the second power line has a second main line and a plurality of second branches. Moreover, the first part of the plurality of driver units are further coupled to the first main line and the corresponding second branches, and a second part of the plurality of driver units are further coupled to the second main line and the corresponding first branches.

In a preferred embodiment of the invention, the first polarity described above is a logical high/low voltage and the second polarity is a logical low/high voltage, and the first and the second polarity are in difference phases.

Accordingly, because the first part and the second part of the driver units of the integrated driver device frame of the present invention are arranged with two staggered rows, the interval of two neighboring output terminals can be equal to the pixel pitch and the resolution of the LCD panel can be enhanced.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. Moreover, each embodiment described and illustrated herein includes its complementary conductivity type embodiment as well.

Figure 1:
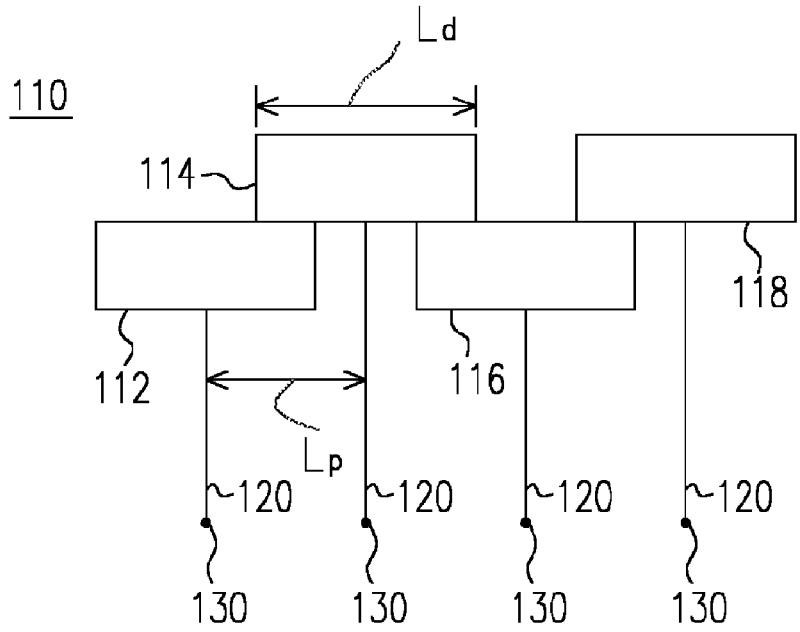
FIG. 1 is a sketch illustrating an integrated driver device frame of a liquid crystal display panel of a preferred embodiment of the present invention.

The present invention provides an integrated driver device frame of a liquid crystal display panel. FIG. 1 is a sketch illustrating an integrated driver device frame of a liquid crystal display panel of a preferred embodiment of the present invention. Referring to the preferred embodiment of the present invention shown in FIG. 1, an integrated driver device frame 100 comprises four driver units 112, 114, 116, and 118, four output terminals 130 and four driving lines 120. Each output terminal is coupled to a corresponding pixel element respectively. To those skilled in the art, the numbers of the driver units, output terminals and driving lines shown in FIG. 1 are only for example and can be extended to any number.

Referring to FIG. 1, the driver units 112 and 116 are located in the second row and the driver units 114 and 118 are located in the first row, and they all have their own driver unit width Ld. Moreover, the driver unit 112 in the second row is contiguous to the diver unit 114 in the first row, and the driver unit 114 in the first row is contiguous to the diver units 112 and 116 in the second row. Therefore, one of the driver units in a row is contiguous to one or two of the driver units in another row.

Referring to the preferred embodiment of the present invention shown in FIG. 1, every one of the output terminals 130 are coupled to a corresponding driving line 120, respectively, and the interval Lp of two neighboring output terminals 130 is equal to the pitch of pixel elements.

Referring to the preferred embodiment of the present invention shown in FIG. 1, the size of the driver unit width Ld is larger than the interval of two neighboring output terminals Lp, and is less than two times of the interval of two neighboring output terminals, i.e., 2Lp. The size of the driver unit width Ld is not equal to Lp and 2Lp, and can be represented as $Lp<Ld<2Lp$.

Figure 2:
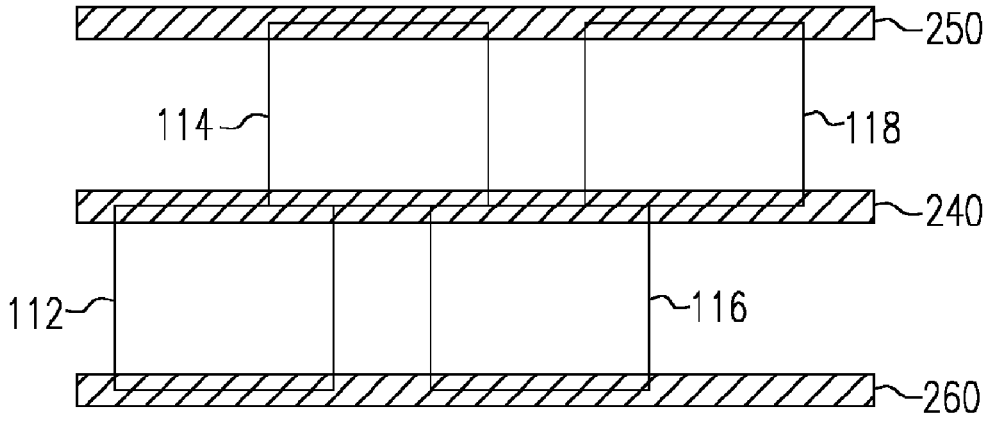
FIG. 2 is a sketch illustrating a connection of power lines of an integrated driver device frame of a liquid crystal display panel of a preferred embodiment of the present invention.

FIG. 2 is a sketch illustrating a connection of power lines of an integrated driver device frame of a liquid crystal display panel of a preferred embodiment of the present invention. The preferred embodiment of the present invention shown in FIG. 2 comprises four driver units 112, 114, 116, and 118, and a plurality of power sources including a first power line 240, a second power line 250 and a third power line 260. The power provides the first power line 240 having a first polarity, a second power line 250 and a third power line 260 having a second polarity. Moreover, the driver units 112 to 118 are coupled to the first power line 240, and the first part of the driver units, i.e., driver units 114 and 118 are coupled to the second power line 250 and a second part of the driver units, i.e., driver units 112 and 116 are coupled to the third power line 260.

Figure 3:
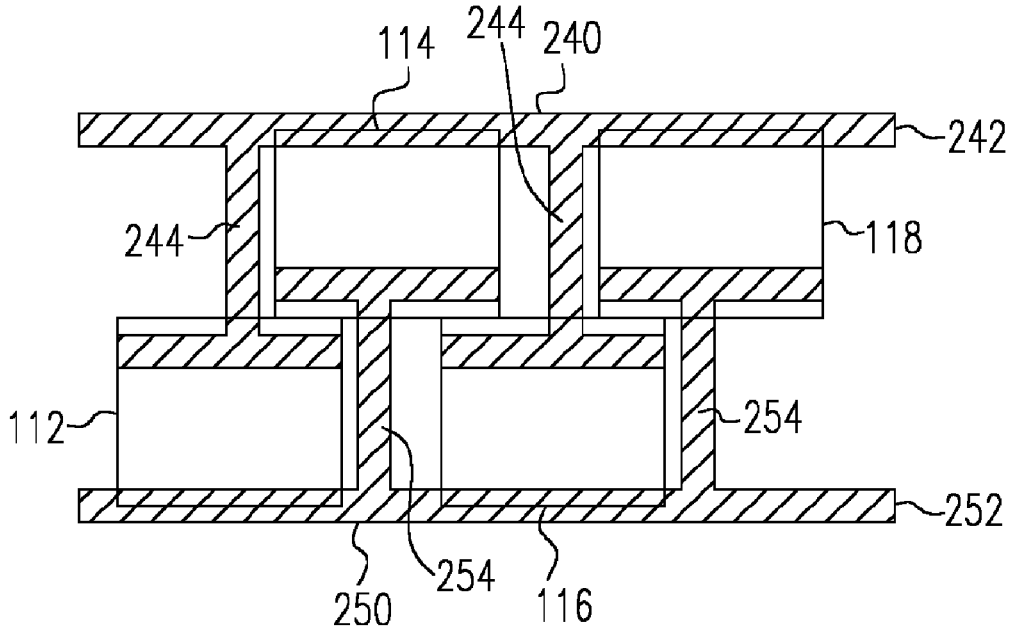
FIG. 3 is a sketch illustrating a connection of power lines of an integrated driver device frame of a liquid crystal display panel of another preferred embodiment of the present invention.
Figure 4:
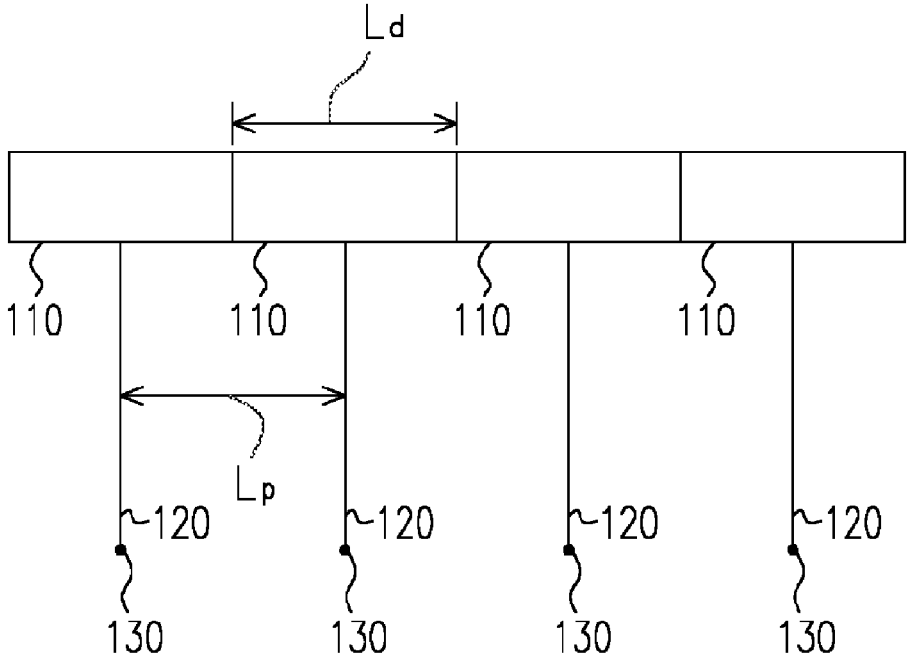
FIG. 4 (PRIOR ART)
FIG. 4 is a sketch illustrating a conventional integrated driver device frame of a liquid crystal display panel.
Figure 5:
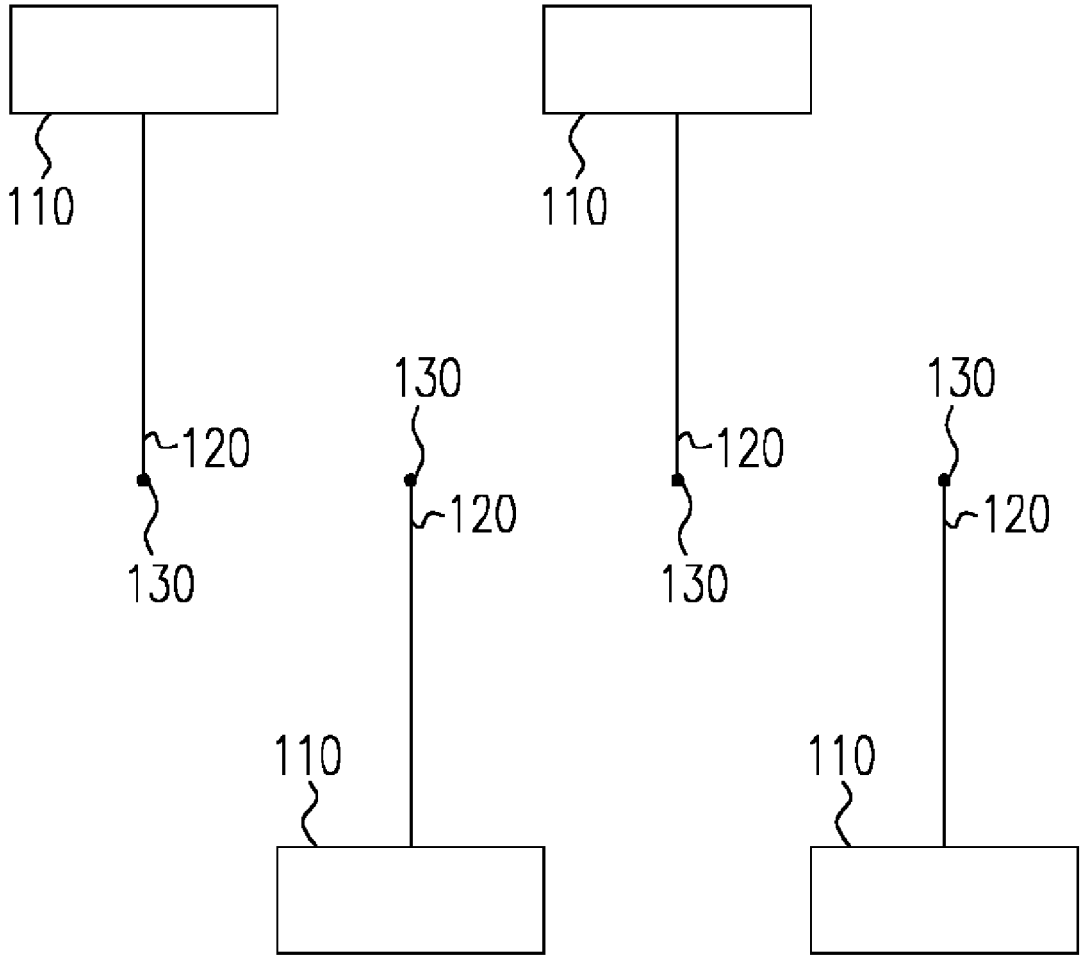
FIG. 5 (PRIOR ART)
FIG. 5 is a sketch illustrating another conventional integrated driver device frame of a liquid crystal display panel.

FIG. 3 is a sketch illustrating another connection of power lines of an integrated driver device frame of a liquid crystal display panel of a preferred embodiment of the present invention. The preferred embodiment of the present invention shown in FIG. 3 comprises four driver units 112, 114, 116, and 118, and a plurality of power sources including a first power line 240 having a first polarity, a second power line 250 having a second polarity.

Referring to the preferred embodiment of the present invention shown in FIG. 3, the power source described above provides the first power line 240 having a first main line 242 and a plurality of first branches 244 and the second power line 250 having a second main line 252 and a plurality of second branches 254. Moreover, the first part of the driver units, i.e., driver units 114 and 118 are coupled to the first main line 242 and the corresponding second branches 254, and a second part of the driver units, i.e., driver units 112 and 116 are coupled to the second main line 252 and the corresponding first branches 244.

To those skilled in the art, in the preferred embodiment of the invention, the first polarity described above can be a logical high (positive) voltage or a logical low (negative) voltage, and the second polarity can be a logical low (negative) voltage or a logical high (positive) voltage, with the first and the second polarities being in a different phase. That is, when the first polarity is a logical high (positive) voltage, the second polarity should be a logical low (negative) voltage; and, on the other hand, when the first polarity is a logical low (negative) voltage, the second polarity should be a logical high (positive) voltage.

Accordingly, because the first part and the second part of the driver units of the integrated driver device frame of the present invention are arranged with two staggered rows, the interval of two neighboring output terminals can be equal to the pixel pitch and the resolution of the LCD panel can be enhanced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

The invention claimed is:

1. An integrated driver device frame of a liquid crystal display panel, comprising:

a plurality of driver units, wherein each driver unit has a corresponding driver unit width and drives a corresponding driving line, respectively; and a plurality of pixels, wherein each pixel is coupled to one of the driving lines;

wherein a relationship between the driver unit width and the interval of two neighboring pixels is that, the driver unit width is larger than the interval of two neighboring pixels and less than two times of the interval of two neighboring pixels.

2. The integrated driver device frame of a liquid crystal display panel of claim 1, wherein the driver unit is composed by a Thin Film Transistor ("TFT").

3. The integrated driver device frame of a liquid crystal display panel of claim 1, further comprises:

a power source for providing a first power line having a first polarity, a second power line and a third power line having a second polarity;

wherein the plurality of driver units are coupled to the first power line, and a first part of the plurality of driver units is further coupled to the second power line and a second part of the plurality of driver units is further coupled to the third power line.

4. The integrated driver device frame of a liquid crystal display panel of claim 3, wherein the first polarity is a logical high voltage and the second polarity is a logical low voltage.

5. The integrated driver device frame of a liquid crystal display panel of claim 3, wherein the first polarity is a logical low voltage and the second polarity is a logical high voltage.

6. The integrated driver device frame of a liquid crystal display panel of claim 3, wherein the first part and the second part of the plurality of driver units are staggered.

7. The integrated driver device frame of a liquid crystal display panel of claim 1, further comprises:

a power source for providing a first power line having a first polarity and a second power line having a second polarity, wherein the first power line has a first main line and a plurality of first branches and the second power line has a second main line and a plurality of second branches;

wherein a first part of the plurality of driver units is further coupled to the first main line and the corresponding second branches, and a second part of the plurality of driver units is further coupled to the second main line and the corresponding first branches.

8. The integrated driver device frame of a liquid crystal display panel of claim 7, wherein the first polarity is a logical high voltage and the second polarity is a logical low voltage.

9. The integrated driver device frame of a liquid crystal display panel of claim 7, wherein the first polarity is a logical low voltage and the second polarity is a logical high voltage.

10. The integrated driver device frame of a liquid crystal display panel of claim 7, wherein the first part and the second part of the plurality of driver units are staggered.

11. An integrated driver device frame of a liquid crystal display panel, comprising:

a plurality of driver units, wherein each driver unit has a corresponding driver unit width and drives a corresponding driving line, respectively; and a plurality of pixels, wherein each pixel is coupled to one of the driving lines;

wherein the plurality of driver units are arranged with two staggered rows, and one of the driver units in a row is neighboring to at least one of the driver units in another row.

12. The integrated driver device frame of a liquid crystal display panel of claim 11, further comprises:

a power source for providing a first power line having a first polarity, a second power line and a third power line having a second polarity;

wherein the plurality of driver units are coupled to the first power line, and a first part of the plurality of driver units is further coupled to the second power line and a second part of the plurality of driver units is further coupled to the third power line.

13. The integrated driver device frame of a liquid crystal display panel of claim 12, wherein the first polarity is a logical high voltage and the second polarity is a logical low voltage.

14. The integrated driver device frame of a liquid crystal display panel of claim 12, wherein the first polarity is a logical low voltage and the second polarity is a logical high voltage.

15. The integrated driver device frame of a liquid crystal display panel of claim 11, further comprises:

a power source for providing a first power line having a first polarity and a second power line having a second polarity, wherein the first power line has a first main line and a plurality of first branches and the second power line has a second main line and a plurality of second branches;

wherein a first part of the plurality of driver units is further coupled to the first main line and the corresponding second branches, and a second part of the plurality of driver units is further coupled to the second main line and the corresponding first branches.

16. The integrated driver device frame of a liquid crystal display panel of claim 15, wherein the first polarity is a logical high voltage and the second polarity is a logical low voltage.

17. The integrated driver device frame of a liquid crystal display panel of claim 15, wherein the first polarity is a logical low voltage and the second polarity is a logical high voltage.

18. The integrated driver device frame of a liquid crystal display panel of claim 11, wherein the driver unit is composed by a Thin Film Transistor ("TFT").

* * * * *